US011365585B1

(12) United States Patent
Watson

(10) Patent No.: US 11,365,585 B1
(45) Date of Patent: Jun. 21, 2022

(54) DEEP HORIZONTAL WATER WELL

(71) Applicant: Roger Watson, Weatherford, OK (US)

(72) Inventor: Roger Watson, Weatherford, OK (US)

( * ) Notice: Subject to any disclaimer, the term of this patent is extended or adjusted under 35 U.S.C. 154(b) by 2 days.

(21) Appl. No.: 17/143,690

(22) Filed: Jan. 7, 2021

Related U.S. Application Data

(63) Continuation-in-part of application No. 16/661,732, filed on Oct. 23, 2019, now abandoned.

(60) Provisional application No. 62/749,350, filed on Oct. 23, 2018.

(51) Int. Cl.

| | |
|---|---|
| ***E21B 7/04*** | (2006.01) |
| ***E21B 43/12*** | (2006.01) |
| ***E21B 47/04*** | (2012.01) |
| ***E21B 23/00*** | (2006.01) |
| ***E21B 47/09*** | (2012.01) |

(52) U.S. Cl.
CPC ..... *E21B 7/046* (2013.01); *E21B 23/00* (2013.01); *E21B 43/121* (2013.01); *E21B 47/04* (2013.01); *E21B 47/09* (2013.01)

(58) Field of Classification Search
CPC ..... E21B 7/046; E21B 23/00; E21B 43/121; E21B 43/13; E21B 47/04; E21B 47/09; E03B 3/08; E03B 3/14
See application file for complete search history.

(56) References Cited

U.S. PATENT DOCUMENTS

| | | | | |
|---|---|---|---|---|
| 5,059,064 | A | 10/1991 | Justice | |
| 5,289,888 | A | 3/1994 | Talley | |
| 5,343,965 | A | 9/1994 | Talley et al. | |
| 5,771,976 | A | 6/1998 | Talley | |
| 8,291,974 | B2 * | 10/2012 | Zupanick ..... | E21B 47/09 166/245 |
| 2003/0042023 | A1 | 3/2003 | Arnold, III | |
| 2005/0241834 | A1 | 11/2005 | McGlothen et al. | |
| 2007/0278008 | A1 | 12/2007 | Kuckes et al. | |

* cited by examiner

*Primary Examiner* — George S Gray
(74) *Attorney, Agent, or Firm* — GableGotwals

(57) ABSTRACT

A system and method for reducing lifting cost per gallon of a vertical water well of this disclosure includes: lowering a location device into the open well bore of the vertical water well until the location device reaches a depth in a range of 0 feet to 30 feet above a bottom end of the vertical water well; determining a predetermined location vertically offset 10 feet to 30 feet below, and coaxial to, the bottom end; drilling, from a horizontally offset position, a horizontal water well using a boring/drilling assembly including a signal transmitter; determining, using signals transmitted and received, a location of the boring/drilling assembly relative to the predetermined location; steering the boring/drilling assembly so that the horizontal water well intersects the predetermined intersecting well depth; intersecting the predetermined location with the boring/drilling assembly; and extending the depth of the vertical water well until it reaches the predetermined location.

9 Claims, 3 Drawing Sheets

DEEP HORIZONTAL WATER WELL

CROSS-REFERENCE TO CO-PENDING APPLICATIONS

This application claims priority to U.S. Non-Provisional application Ser. No. 16/661,732, filed Oct. 23, 2019, which in turn claimed priority to U.S. Provisional Application No. 62/749,350, filed Oct. 23, 2018, the content of both applications being incorporated herein by reference.

BACKGROUND

This disclosure is in the field of high production well water completion systems.

Horizontal or near horizontal drilling methods have been used in well water applications. For example, U.S. Pat. No. 5,771,976 to Talley et al. discloses a horizontal or near horizontal, water well in combination with a vertical well bore. The horizontal well is drilled independent of the vertical well from an offset position near the well by forcing bit pipe into the ground, passes by the vertical well, and extends in a horizontal direction to one side of the vertical well. See also U.S. Pat. Nos. 5,289,888 and 5,343,965 to Talley et al. (disclosing horizontal water well completion methods). The offset position is typically about 100 feet in any direction from the vertical well, with the bit pipe making a turn from 0° to 90° as it travels downward over that horizontal distance.

However, the prior art methods are not cost effective and, as a result, have not been widely adopted if adopted at all. The use of bent pipe with a vertical drilling rig is expensive, the pipe has to be excessively bent to make the turn or corner, and it can be difficult if not impossible to hit the intended target. Additionally, the methods cannot intersect the vertical well. No means are provided to detect, during drilling, where the far end of the bit pipe is in relation to the vertical well. And, if the vertical well were to be intersected (creating a zero or low pressure zone), there are no means provided for controlling circulation. The methods also require sufficient porosity in the surrounding rock formation such that water from the exposed rock can travel from the horizontal well to the vertical well.

U.S. Pat. No. 8,291,974 B2 to Zupanik discloses horizontal drilling into coal seams separated by noncoal layers, with the horizontal well taking advantage of the porosity of the coal seam and intersecting an enlarged cavity formed in a vertical well bore that provides a collection point for fluids drained from the coal seam during production operations. The vertical well is used to remove the collected fluids. US 2007/0278008 to Kuckes et al. discloses horizontal drilling guided by beacons that are located along a reference (existing) horizontal well located below or adjacent the horizontal well being drilled so that the horizontal wells do not intersect one another.

SUMMARY

Embodiments of a system and method of drilling a water well of this disclosure include:

locating a bottom end of a vertical water well;

determining a predetermined location vertically offset from, and coaxial to, the bottom end;

drilling, from a horizontally offset position relative to the vertical water well, a horizontal water well using a boring/drilling assembly including a signal transmitter;

determining, using signals transmitted and received, a location of the boring/drilling assembly relative to predetermined location;

steering the boring/drilling assembly so that the horizontal water well intersects the predetermined location; and intersecting the predetermined location with the boring/drilling assembly; and The predetermined location may be between a pump setting depth and a bottom end of the vertical water well, the bottom end of the vertical water well, or below the bottom end of the vertical water well.

Where the predetermined location is at the bottom end, the system and method may further include drilling through the bottom end of the vertical water well to extend the vertical water well to a second bottom end at or below the horizontal water well. Where the predetermined location is below the bottom end of the vertical water well, the system and method may include drilling through the bottom end of the vertical water well to extend the vertical water well until the vertical water well at least intersects the horizontal water well. In embodiments, the second bottom end does not extend below the horizontal water well.

In some embodiments, the locator, which may be a beacon transmitter/receiver, may be placed down a bore of the vertical water at the bottom end or the predetermined location. In other embodiments the locator can be placed at surface without running the locator inside the vertical water well.

In embodiments, the horizontal water well may extend past the predetermined location a predetermined horizontal distance. In other embodiments, the horizontal water well may continue past the predetermined location and back to surface on an opposite side of the vertical water well. By way of a non-limiting example, the horizontal water well may be drilled past the vertical water well a certain horizontal distance or drilled back up to surface, pulling pipe back into the well for gravel pack and other completion operations.

Because the vertical well bore has not been intersected during the horizontal water well phase, chances of drilling the vertical water well with no or little lost circulation improve. After all is in place on the horizontal water well, the vertical water well may be entered with a bit and pipe and drilled down through the horizontal water well a predetermined vertical distance below the horizontal water well, thus allowing the cuttings a place to settle and not interfere with water production.

DETAILED DESCRIPTION

For the purposes of this disclosure, vertical well means a vertical water well. Horizontal well means a horizontal water well. The bottom end of the vertical well means that linear portion of the vertical well lying at or between the bottommost end of the well bore and the pump setting depth. Intersecting the bottom end of the vertical well means that a circumferential portion of the horizontal well passes through, or lies tangential to, an opposing portion of the bottom end.

Figure 1:
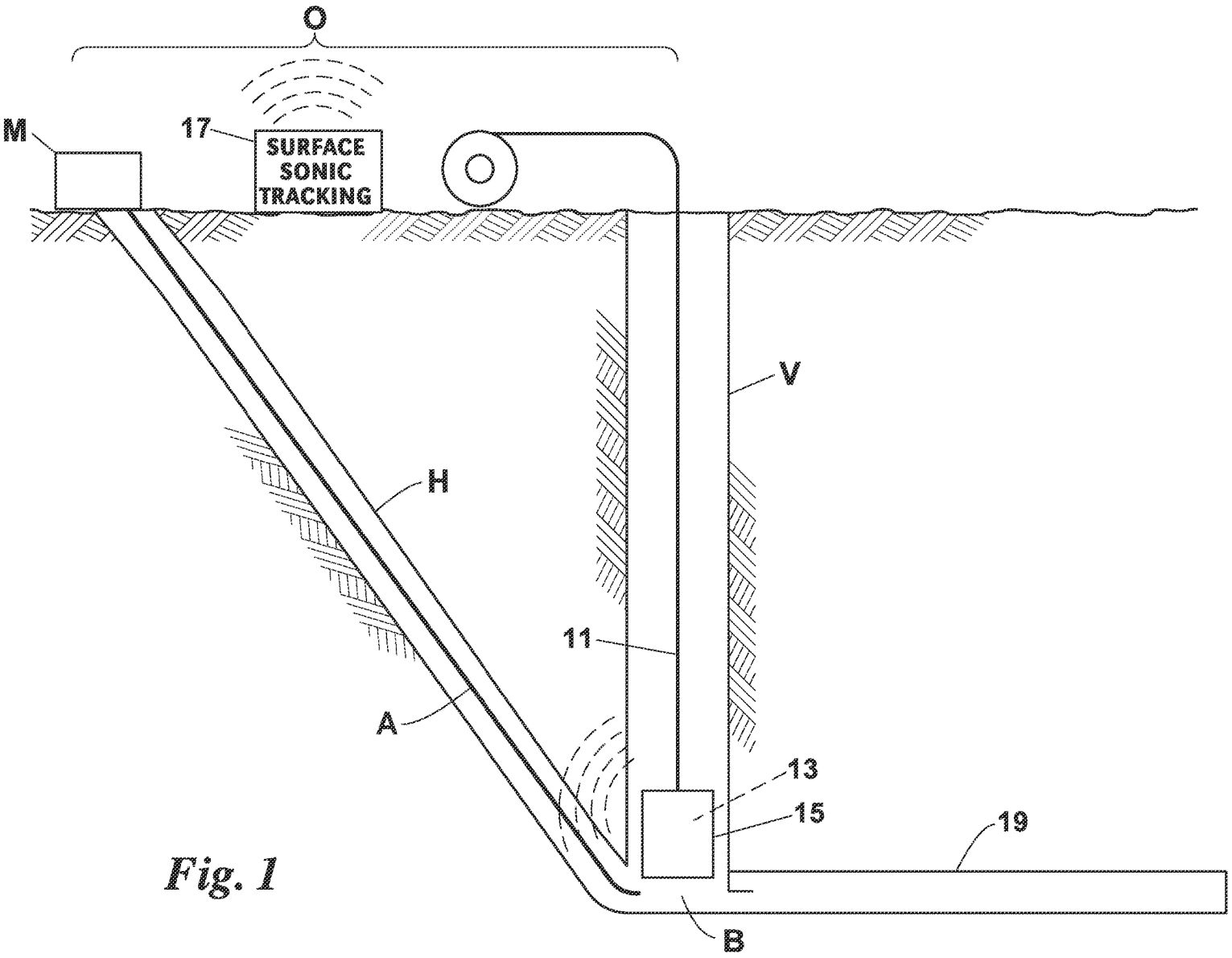
FIG. 1 is a schematic of an extended reach horizontal water well that intersects a vertical water well below the pump setting depth. In some embodiments, the horizontal water well may be drilled from an offset position of about 200 feet from the vertical well at a 20° to 70° radius of curvature. In other embodiments, the horizontal water well is below that of the vertical water well and then the vertical water well is extended to intersect and, in some embodiments, go below the horizontal water well.
Figure 2:
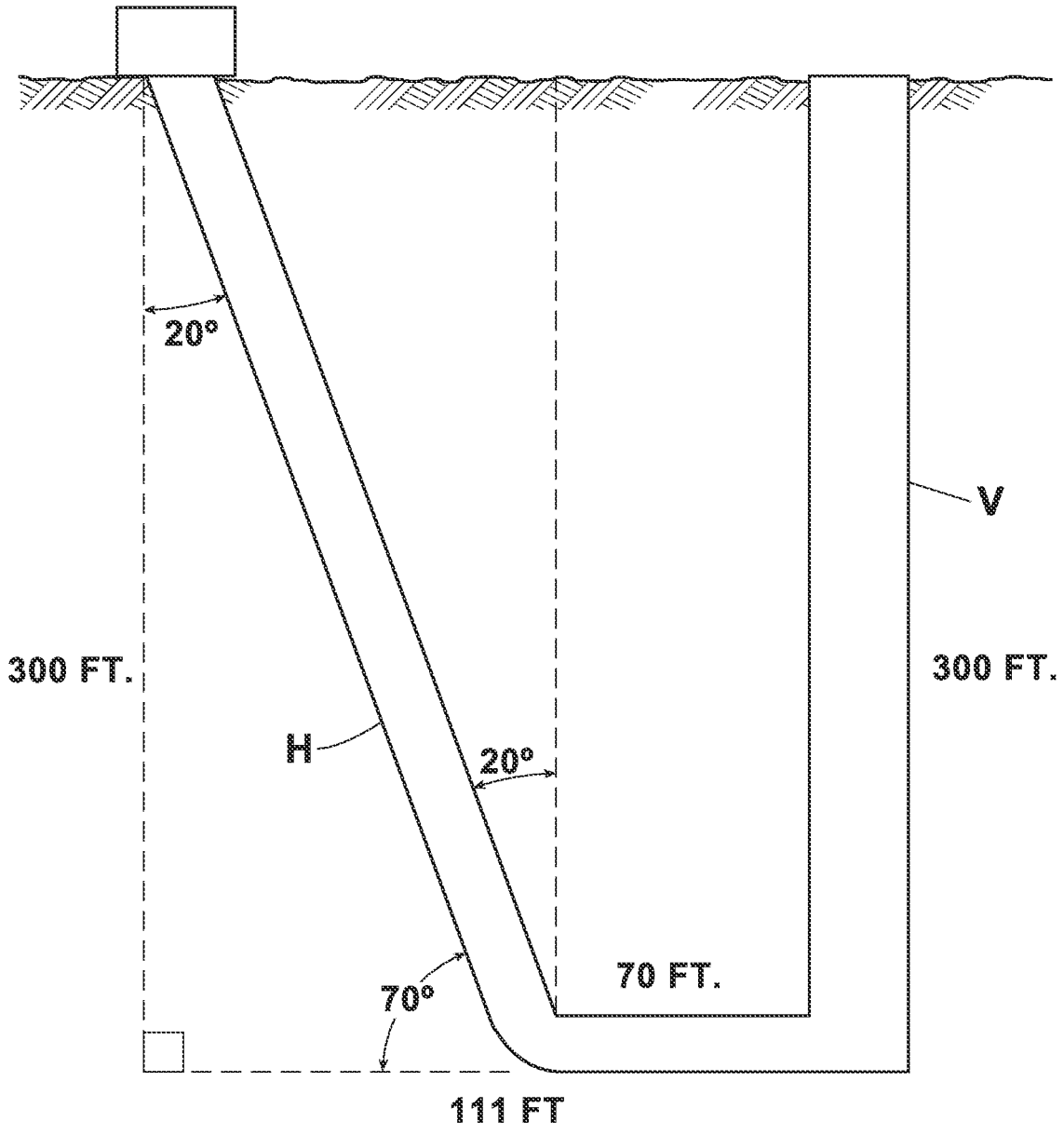
FIG. 2 is a schematic of a horizontal water well in which the extended reach portion of the horizontal water well is on a same side of the vertical water well as the offset position. In some embodiments, the vertical water well may then be drilled to intersect a far end of the extended reach portion.

Referring to FIG. 1, in embodiments of this disclosure, and unlike the prior art, a directional boring/drilling machine M of a kind known in the art and including a boring/drilling assembly A is employed so that the horizontal well H may be drilled through, not near, a vertical well bore V and engage the vertical well bore directly. The boring/drilling assembly may include a bit at its downstream end, a motor that turns the bit, turn pipe (e.g. a bent piece of drill pipe or tubing), a signal transmitter, and drill pipe located between the transmitter and the upstream end. In some embodiments, the horizontal well is drilled from an offset position relative to the existing vertical well or newly drilled vertical well. The offset position is determined, in part, by the intersecting bottom depth D and the vertical offset or angle of the boring/drilling machine. In some embodiments, this angle may be in a range of 20° off vertical to 70° off vertical, there being subranges within this broader range. See e.g. FIG. 2. In other embodiments, the angle may be in a range of 15° to 25° off vertical, there again being subranges within this broader range. The offset position O may be 200 feet (or more) from the vertical well and drilled to a water-bearing sandstone level that intersects the vertical well below its pump setting depth.

After intersecting the bottom of the vertical well bore, the boring drilling unit or machine may further drill the horizontal section to one side of the vertical well, thereby increasing exposure to the reservoir rock. In some formations, this extended horizontal section 19 may be at a depth of up to 100 feet, up to 300 feet, or up to 900 feet, depending on where the water-bearing sandstone level is located (there being other depths within this broader range). Prior to intersecting the vertical well, the vertical well is mudded in an amount effective to provide sufficient pressure balance.

The well may be open hole, sand controlled, or cased. Casing may be pulled back through the horizontal well. Tile and perforated casing may be pulled back through the horizontal well. Gravel pack may be pumped in or prepacked. Gravel pack tools may be pulled back through the horizontal well.

In other embodiments, the horizontal section may be drilled such that the horizontal section is located on the offset side, extending to and intersecting the vertical well bore. In yet other embodiments, the vertical well may intersect a near or far end of this horizontal section. The horizontal well may also intersect the vertical well bore such that the bottommost end of the vertical well bore sits lies on an opposing circumferential portion of the horizontal well bore. In other embodiments, the horizontal well is to the side of the vertical well, that is, a circumferential portion of the vertical well bore lies on an opposing circumferential portion of the horizontal well bore.

Figure 3:
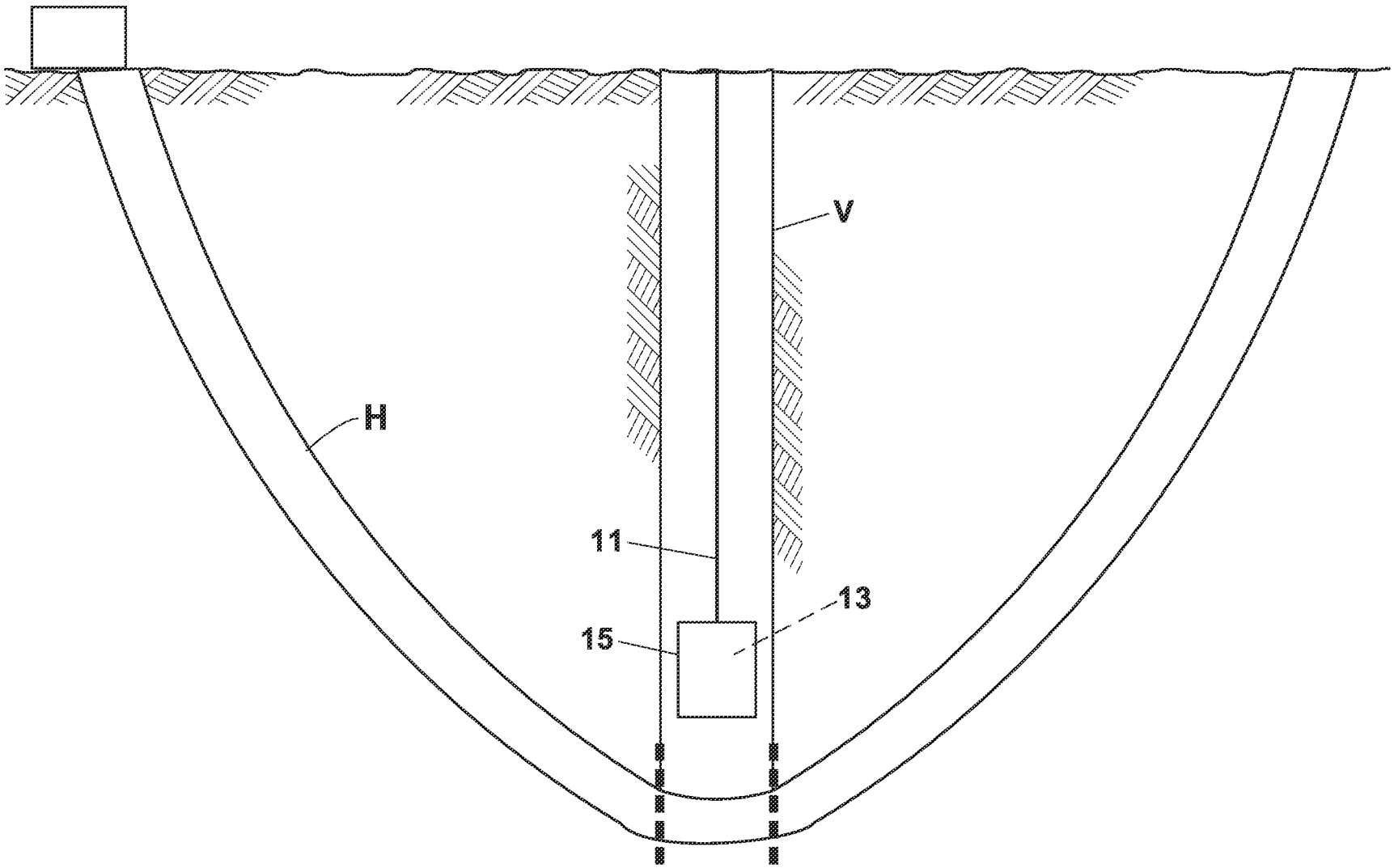
FIG. 3 is a schematic of an embodiment in which, once the horizontal section is complete, the boring drilling unit comes to surface on an opposite side of the vertical well bore. In other embodiments, the horizontal section may be located below the vertical water well and, after the horizontal section is complete, the vertical water well may be extended downward through and below the horizontal section.

The boring/drilling machine may drill from its offset position and, once the horizontal section is complete, come to surface on an opposite side of the vertical well bore. See e.g. FIG. 3. This approach provides options of leaving the horizontal well as-is, pulling casing back through the well, pulling gravel pack tools back through, or pulling tile and perforated casing back through.

Various methods may be used to find the bottom of the vertical well bore. One method may use electric wireline 11 to determine where the bottom of the well bore is located while drilling. However, a more economical method includes a boring/drilling assembly equipped with a transmitter and a locator or tracking device 13 located in the vertical well bore. In embodiments, the tracking device 13 may be located above and near to the pump setting depth. The tracking device 13 may be contained by a non-metal tubular enclosure 15 deployed downhole by a wire or cable. In some embodiments, the non-metal tubular composure is a plastic composite pipe. In other embodiments the locator or tracking device 13 can be placed at surface without running the locator inside the vertical water well. By way of a non-limiting example, the device 13 may be placed at surface and include a beacon transmitter/receiver having a signal depth (range) of about 300 feet or, in some embodiments, 400 feet.

The tracking device 13 may include a receiver and a microprocessor with associated software to process the received signal and determine an X-Y-Z coordinate location of the boring/drilling assembly. Or, the tracking device 13 may transmit the signal to a reader or mobile device 17 located at surface that contains signal processing capability. In yet other embodiments, the tracking device 13 may be an X-Y-Z locator such as a gyroscope or its equivalent that is lowered into the bore of the vertical well bore. The X-Y location of the bottom end may then be marked at surface.

The signal may be a pulse or radio frequency signal using a known industrial, scientific, and medical band frequency or protocol (e.g. 2.4 GHz protocol). When the end of the drilling assembly gets near the locator 13, the locator 13 picks up the reading and may relay it back to the driller by electric cable or wirelessly. The boring/drilling assembly may then be steered as needed to intersect the bottom of the vertical well or a location directly below the bottom end of the vertical well.

The vertical and horizontal wells may be any size. For example, and by way of a non-limiting example, the wells may require an 8-inch, 12-inch, or 18-inch hole. For irrigation purposes, a vertical well should provide at least 250 gallons per minute. Adding a horizontal well of this disclosure to this irrigation well may increase overall flow by a factor of three, providing 700 gallons per minute to 900 gallons per minute. Flows in this range would permit irrigation for about 8 hours at night, rather 24 hours at 250 gallons per minute. Irrigation at night has advantages since water is not lost to evaporation, which may be about 2/10" during the day.

In some embodiments, the directional boring/drilling unit may be used to drill a large (e.g. 16" diameter) well that turns horizontal and extends a sufficient distance to provide exposure that achieves a flow of effective for a frac job, that is, in a range of about 3,500 gallons per minute to 4,500 gallons per minute, there being subranges within this broader range. In some embodiments, about 4,200 gallon per minute are provided. This would eliminate the need to haul water by truck or pump it long distances in order to frac the well. A larger pump is needed here than that used for irrigation but there are electrical submersible pumps of a kind known in the art that can do that. Of course, the well site would need to have a water zone in a same area as the oil/gas well is being drilled.

Compared to the prior art methods, a well of this disclosure reduces cost by about a one-third and reduces drilling time to about half-a-day (from surface to intersection).

In other embodiments of the system and method—and by way of a non-limiting example where a vertical well has been drilled and equipped with a pump—the pump is pulled and a X-Y-Z location device such as a gyroscope, accelerometer, or its equivalent may be run down hole to locate the bottom of the vertical well (e.g., Z feet). The X-Y location of the bottom is then marked at surface (since the vertical well is unlikely to be perfectly vertical from surface to bottom). A horizontal offset O is then made relative to that surface location (e.g. Z=240 feet and O=450 feet) for a horizontal boring/drilling machine to drill at a proper angle and curve to hit the bottom location Z or, if desired, a location Z+/−Δ vertically offset from the bottom where −Δ may place the location of the horizontal section between the bottom end and a pump setting depth and +Δ lies below the bottom end (e.g. a 2 or 3 feet up to 5, 10, 15, 20, 25 feet or more depending such factors as the depth of the vertical well section, water table height, and surrounding rock formations). The horizontal well section may extend past this location a predetermined horizontal distance X and, in some embodiments, may curve and return at an angle back to surface on an opposite side of the vertical well. The pipe is pulled and, where the horizontal section is at Z+Δ the vertical water well is further drilled downward at least the distance Δ and through the horizontal section another predetermined vertical distance γ, where γ may be 2 or 3 feet to—5, 10, 15, 20, 25, feet or more) thereby creating a rat hole. This approach helps prevent lost circulation in the well.

Embodiments of a method of this disclosure to drill and complete a water well up to 900 feet from surface using horizontal drilling methods include the methods described below. The methods may be used to access a water reservoir below surface where water is needed to support industry, provide water for human consumption in a metropolitan area or for an individual. It may also be used to remove water from an area and can be a source for irrigation of crop lands. A combination of one method with another may be used to provide a method that best fits the application needed to meet volume, commercial, and regulated production. By way of a non-limiting example, multiple vertical wells may intersect with the horizontal well to provide more than one, two or three water production access points to the aquifer. Or, multiple horizontal wells maybe connected to the multiple vertical wells Method 1—Existing Water Well Enhancement. This methods takes an existing water well that needs to be improved from its limited current water flow rate to a commercial flow rate. The existing water well has a current pump in place and has a vertical well that is drilled into the water aquifer. The process to enhance this well to a commercial state would be the following:

a. Pull existing pump, rods and or electric pump and cable from the well leaving a full well bore open.
b. Deploy a locator unit to the bottom of the existing vertical water well and hang it less than 30 feet from the bottom of the vertical well.
c. Set up a horizontal drilling unit (boring machine) with in a predetermined location from the existing well bore. This distance is envisioned to be, but not limited to, between 300 to 2600 feet more or less.
d. Drill at an angle toward the vertical well until the predetermined depth of the horizontal drilling assembly is reached.
e. Adjust angle to intersect the bottom of the vertical well.
f. Drill horizontal the distance required to intersect the vertical well.
g. Using the locator in the bottom of the vertical well and the locator on the bottom of the drilling pipe, connect the horizontal well to the vertical well at the predetermined location so as to have a continuity of both well bores.
h. Pull drill pipe and bottom hole assembly from the horizontal well bore and cap the surface pipe per state or local regulations.
i. The horizontal well bore may be left as an open hole, perforated casing, or sand control screens with casing, depending on the continuity of the water pay sand drilled through.
j. Pull the locator from the bottom of the vertical well.
k. Deploy the pump and pumping accessories back into the vertical well and set up for production of water.
l. Run pump to clean up the well and monitor for pumping data.

Method 2. Follow Method 1 a. to f and then.

g. Using the locator in the bottom of the vertical well and the locator on the bottom of the drilling pipe, drill the horizontal well in line (directly beneath) with the vertical well at predetermined location of 10 to 30 feet below the bottom of the vertical well bore.
h. Pull the bottom hole assembly back up the horizontal well bore at least 30 feet and continue to monitor well.
i. Pull the locator from the bottom of the vertical well.
j. Run in the drilling bottom hole assembly with the vertical well drilling rig and tag the bottom of the vertical well bore.
k. Drill down to intersect with the horizontal well bore. Continue drilling below the horizontal well bore to predetermined depth to ensure connectivity.
l. Circulate drilling fluids then pull out of the vertical well bore.
m. Pull drill pipe and bottom hole assembly from the horizontal well Bore and Cap the surface pipe per state or local regulations.
n. The horizontal well bore may be left as an open hole, perforated casing, sand control screens with casing, depending the continuity of the water pay sand drilled through.
o. Deploy the pump and pumping accessories back into the vertical well and set up for production of water.
p. Run pump to clean up the well and monitor for pumping data.

Method 3. Follow Method 1 in its entirety except take out step g. and insert the following to replace it:

g. Using the locator in the bottom of the vertical well and the locator on the bottom of the drilling pipe, connect the horizontal well to the vertical well at predetermined location so as to have a continuity of both well bores. Continue drilling horizontal to a predetermined distance. This distance to be determined by the amount of horizontal well area needed to meet the commercial output of the water well.

Method 4. Follow Method 2 in its entirety except at step g add the following.

g.1. Continue drilling horizontal to a predetermined distance. This distance to be determined by the amount of horizontal well area needed to meet the commercial output of the water well.

g.2. Pull the horizontal bottom hole drilling assembly back to the bottom of the vertical well and go to step h.

Method 5. Follow Method 1 from step a. to step g., then:

h. Using the locator in the bottom of the vertical well and the locator on the bottom of the drilling pipe, connect the horizontal well to the vertical well at predetermined location so as to have a continuity of both well bores. Continue drilling horizontal to a predetermined distance. This distance to be determine by the amount of horizontal well area needed to meet the commercial output of the water well.

i. Continue drilling at an angle to reach surface on opposite side of well the horizontal drilling rig is set up.

j. After reaching surface at a predetermined location with the bottom hole drilling assembly and drill pipe, hook onto either, perforated pipe, casing pipe with sand control screens, or a type of pipe to help keep the well from collapsing.

k. Pull this pipe that has been pre-assembled back into the horizontal well bore and set it at a predetermined location in the well bore.

l. Unhook from the pipe and pull the bottom hole assembly and drill pipe back to surface at the horizontal drilling rig.

m. Pull the locator from the bottom of the vertical well.

n. Deploy the pump and pumping accessories back into the vertical well and set up for production of water.

o. Run pump to clean up the well and monitor for pumping data.

Method 6. Follow Method 1 from step a. to step f., then:

g. Using the locator in the bottom of the vertical well and the locator on the bottom of the drilling pipe, drill the horizontal well in line (directly beneath) with the vertical well at predetermined location of 10-30 feet below the bottom of the vertical well bore.

h. Continue drilling the horizontal well bore to a predetermined distance from the vertical well intersection.

i. Start to drill at an upward angle to breach the surface at a predetermined location.

j. After reaching surface at a predetermined location with the bottom hole drilling assembly and drill pipe, hook onto either, perforated pipe, casing pipe with sand control screens, or a type of pipe to help keep the well from collapsing.

k. Pull this pipe that has been pre-assembled back into the horizontal well bore and set it at a predetermined location in the well bore.

l. Unhook from the pipe and pull the bottom hole assembly and drill pipe back to surface at the horizontal drilling rig.

m. Pull the locator from the bottom of the vertical well.

n. Run in the drilling bottom hole assembly with the vertical well drilling rig and tag the bottom of the vertical well bore.

o. Drill down to intersect with the horizontal well bore. Continue drilling below the horizontal well bore to predetermined depth to ensure connectivity.

p. Circulate drilling fluids then pull out of the vertical well bore.

q. Pull drill pipe and bottom hole assembly from the horizontal well bore and cap the surface pipe per state or local regulations.

r. The horizontal well bore may be left as an open hole, perforated casing, sand control screens with casing, depending the continuity of the water pay sand drilled through.

s. Deploy the pump and pumping accessories back into the vertical well and set up for production of water.

t. Run pump to clean up the well and monitor for pumping data.

Method 7—New Vertical Well. Water wells made using Methods 1 to 6 can be accomplished as stated with an existing vertical water well or each method can be done with a new vertical water well. The new vertical water well must be drilled prior to starting the horizontal portion of each method.

Method 8—Horizontal only Water Well Completion. This method includes drilling only the horizontal well to produce water from the reservoir. There is no vertical well included in this method. An electric submersible pump can be deployed on one end of the well bore and produced or there can be two pumps deployed, one from each end and set up to produce water.

a. Set up a horizontal drilling unit (boring machine) within a predetermined location from the existing well bore. This distance is envisioned to be in an area that allows horizontal drilling that stays with in the boundary of property agreements.

b. Drill at an angle toward the desired direction until the predetermined depth of the horizontal drilling assembly is reached.

c. Once the vertical depth is reached, then turn and drill horizontally for predetermined distance.

d. Once the horizontal distance is reached turn the drilling assembly at the angle to drill back to surface.

e. Once the surface has been breached, then hook onto the pre-assembled pipe, sand screens, completion Tools and start to pull them into the well bore.

f. Pull the pre-assembled pipes and tools into the wellbore to a predetermined location. Disconnect from the casing and pull the drilling assembly out of the well to surface.

g. Deploy electric submersible pump of adequate size to produce the amount of water required. Deploy on tubing with the size large enough to produce what the electric pump puts out.

h. If desired, deploy a second electric submersible pump of adequate size to produce water required. This set up will have water produced from each end of the horizontal water well. Finish the completion at surface with flow pipes and electric connections.

i. Produce the horizontal well and monitor output.

Method 9—Horizontal only Water Well Completion. This method includes drilling only the horizontal well to produce water from. There is no vertical well included in this method. This method will only product water from one end of the horizontal well bore.

a. Set up a horizontal drilling unit (boring machine) within a predetermined location. This distance is envisioned to be in an area that allows horizontal drilling that stays within the boundary of property agreements.

b. Drill at an angle toward the desired direction until the predetermined depth of the horizontal drilling assembly is reached.

c. Once the vertical depth is reached, then turn and drill horizontally for predetermined distance. This distance is envisioned to be an area that will provide enough reservoir to rock surface area to provide a commercial amount of water to be pumped to surface.

d. Upon completing the horizontal drill depth, then pull bottom hole assembly and drill pipe out of the wellbore.

e. Deploy perforated pipe, pipe and sand screens, or leave in the open hole state and cement the surface pipe per state or local regulations at surface.

f. Run the electric submersible pump with production flow pipe to desired depth into the horizontal well. The size of the pump is determined by how much water is needed or expected to be pumped, and the size of the well is decided by the OD of the pump deployed.

g. Connect the completion surface assemblies and set up pipes to control the produced water.

h. Flow the water well and monitor flow.

While embodiments of a deep horizontal water well and method of its drilling and use have been described, the invention is limited by the following claims, including the full range of equivalents to which each recited element is entitled.

What is claimed:

1. A method for increasing production and reducing lifting cost per gallon of a vertical water well, the method comprising:

pulling a pump and associated pumping equipment from the vertical water 5 well to provide an open well bore;

lowering by wire a location device into the open well bore of the vertical water well until the location device reaches a depth in a range of 0 feet to 30 feet above a bottom end of the vertical water well, the bottom end of the vertical well being within water-bearing 10 sandstone layer and having a depth from surface in a range of 100 feet to 300 feet, the location device being housed in a non-metal tubular enclosure and including a signal receiver and a signal transmitter;

determining a predetermined location vertically offset from, and coaxial to, the bottom end of the vertical water well, the predetermined location being in a range of 10 feet to 30 feet below the bottom end of the vertical well;

drilling, from a horizontally offset position relative to the vertical water well, a horizontal water well using a boring/drilling assembly 20 including a signal transmitter, the horizontally offset position being in a range of 200 feet to 2,600 feet from the vertical water well, a portion of the horizontal water well located at depth from surface in a range of 100 feet to 300 feet being in the water-bearing sandstone layer;

determining, using signals transmitted to and received by the location device, a location of the boring/drilling assembly relative to the predetermined location;

steering the boring/drilling assembly so that the horizontal water well intersects the predetermined location; intersecting the predetermined location with the boring/drilling assembly; and after the intersecting the predetermined location:

raising the location device to remove the location device from the vertical water well;

inserting a boring/drilling assembly into the vertical water well;

extending a depth of the vertical water well by drilling through the bottom end of the vertical water well to the predetermined location so the bottom end intersects the horizontal water well, a bore size of the vertical water well being constant along the entire length of the vertical water well; and reinstalling the pump and associated pumping equipment in the vertical water well.

2. The method of claim 1, further comprising, after the intersecting the predetermined location, drilling an extended horizontal reach section of the horizontal water well.

3. The method of claim 1, further comprising, after the intersecting the predetermined location, drilling back to surface on a side of the vertical water well opposite that of the horizontally offset position.

4. The method of claim 1, further comprising:

pumping water from the vertical water well.

5. The method of claim 4, further comprising:

irrigating a portion of a field with the pumped water.

6. The method of claim 4, wherein, water pumped from the vertical well does not require post pumping treatment for use.

7. The method of claim 1, further comprising, capping the horizontal water well.

8. The method of claim 1, wherein, the bore size of the vertical water well is different than a bore size of the horizontal water well.

9. The method of claim 1, wherein, the bore size of the vertical water well is in a range of 8 inches to 12 inches.

* * * * *